US009336760B2

(12) United States Patent
Singh et al.

(10) Patent No.: US 9,336,760 B2
(45) Date of Patent: May 10, 2016

(54) GENERATING MUSIC FROM IMAGE PIXELS

(71) Applicants: Rajinder Singh, San Jose, CA (US); Ihab Abu-Hakima, Los Altos, CA (US)

(72) Inventors: Rajinder Singh, San Jose, CA (US); Ihab Abu-Hakima, Los Altos, CA (US)

( * ) Notice: Subject to any disclaimer, the term of this patent is extended or adjusted under 35 U.S.C. 154(b) by 0 days.

(21) Appl. No.: 14/817,205

(22) Filed: Aug. 3, 2015

(65) Prior Publication Data

US 2016/0035330 A1 Feb. 4, 2016

Related U.S. Application Data

(60) Provisional application No. 62/032,486, filed on Aug. 1, 2014, provisional application No. 62/053,181, filed on Sep. 21, 2014.

(51) Int. Cl.
*G04B 13/00* (2006.01)
*G10H 1/02* (2006.01)

(52) U.S. Cl.
CPC ..... *G10H 1/02* (2013.01); *G10H 2250/615* (2013.01)

(58) Field of Classification Search
CPC ... G06F 3/04845; G06F 3/0235; G10H 1/368; Y10S 715/967; G06K 9/00013; A61M 2021/005; H04N 21/8153; H04N 7/185
See application file for complete search history.

(56) References Cited

U.S. PATENT DOCUMENTS

2010/0092107 A1* 4/2010 Mochizuki ..... H04N 9/8211 382/309
2012/0007892 A1* 1/2012 Ohkubo ..... G11B 27/034 345/667
2012/0011472 A1* 1/2012 Ohkubo ..... G06F 3/04845 715/838
2012/0011473 A1* 1/2012 Ohkubo ..... G06F 17/30274 715/838
2013/0322651 A1* 12/2013 Cheever ..... H03G 5/00 381/101
2016/0035330 A1* 2/2016 Singh ..... G10H 1/02 84/609

* cited by examiner

*Primary Examiner* — Marlon Fletcher
(74) *Attorney, Agent, or Firm* — Law Office of Dorian Cartwright; Dorian Cartwright

(57) ABSTRACT

Musical compositions are generated from image pixels. To do so, pixel values are mapped to musical elements together for creating the musical compositions. Additionally, images are formed from pixels generated from musical compositions. More generally, a computer system creatively generates media using captured media as a source. The system also generates collage images in which individual images are pixels for the collage image. Collages are further generated from text.

15 Claims, 16 Drawing Sheets

100

200A

400B

500B

GENERATING MUSIC FROM IMAGE PIXELS

CROSS-REFERENCE TO RELATED APPLICATIONS

This application claims the benefit of priority under 35 U.S.C. 119(e) to U.S. Application No. 62/032,486, filed Aug. 1, 2014, entitled COLLAGE-BASED REPRESENTATION OF IMAGES AND MUSIC, by Rajinder SINGH, and to U.S. Application No. 62/053,181, filed Sep. 21, 2014, entitled COLLAGE-BASED REPRESENTATION OF IMAGES AND MUSIC, by Rajinder SINGH, the contents of both being hereby incorporated by reference in their entirety.

FIELD OF THE INVENTION

The invention relates generally to computer software, and more specifically, to generating musical compositions from image pixels in a computing environment.

BACKGROUND

Personal media libraries are on the rise. First, low cost still cameras and video cameras allow users to capture media in almost any venue. Further, the advent of inexpensive and vast storage resources removes limitations of selectively capturing and saving media. Additionally, nearly infinite stores of media are available for download on the Internet from social networking, e-mail and search engine results. Once a computing or media device is obtained, the cost of building personal media collections is negligible.

For example, pre-teenagers often own smart telephones (tablets and other devices) with the ability to take photos on a whim, and thousands of photos can be stored within the small devices. Many users own several other media capturing devices, such as tablet computing device, laptops with integrated cameras, digital still cameras, in addition to media downloaded from the web sites on the Internet and e-mailed amongst friends. All in all, users have large personal media libraries at their disposal on portable computing devices.

One way to share media is through social networking such as Facebook or Instagram. Additionally, media can be printed out as photographs or burned onto a DVD. Multiple photographs can be combined into a standard-shaped collage. Editing programs allow digital media to be processed by combining, cropping, correcting, and the like.

However, none of these techniques allow users to enjoy captured media by generating creative media using captured media as components. In particular, there is no technique to generate a musical composition from pixels of an image.

SUMMARY OF THE DISCLOSURE

Methods, computer-readable mediums, and system for generating a musical composition from image pixels are described. Also, an image can be generated from music.

To do so, pixel values are mapped to musical elements together for creating the musical compositions. Additionally, images are formed from pixels generated from musical compositions. More generally, a computer system creatively generates media using captured media as a source. The system also generates collage images in which individual images are pixels for the collage image. Collages are further generated from text Additionally, the algorithms described herein can be executed on low-power devices such as mobile and handheld devices (e.g., smart cell phones, laptops, tablets, etc.). The techniques can thus process large graphical files locally and with no or limited off-loading to a remote server. The results can be shared from the low-power device.

BRIEF DESCRIPTION OF THE DRAWINGS

In the following drawings, like reference numbers are used to refer to like elements. Although the following figures depict various examples of the invention, the invention is not limited to the examples depicted in the figures.

DETAILED DESCRIPTION

Methods, computer-readable mediums, and system for generating a musical composition from pixels of an image are described. Also, an image can be generated pixel by pixel, from a musical composition.

More generally, a computer system creatively generates media using captured media as a source. Thus, music generation from image pixels, described below, is just one aspect of the system capabilities. Music generation capabilities can be implemented independently or in coordination with other media generation capabilities. In other embodiments, a collage of individual images appears itself to be an image. The individual images are pixels for the collage image. Also, a collage can be generated from text such as ASCII characters. The following description is intended to be exemplary embodiments for the purpose of illustration and not to limit additional embodiments that would be apparent to one of ordinary skill in the art, in view of the description.

Musical compositions, as referred to herein, include any type of music that can be played back on a computing device, including songs, solo instrumentals, band instrumentals, random sounds, and the like. More specifically, a musical composition is made up of a string of musical elements derived from image pixels. Each pixel of a media source can represent, for example, one or more chords, one or more instruments, an adjustment to volume, or the like. Musical compositions can also be generated from video, collages, or other media sources.

I. System to Generate Music from an Image or Collage of Images

Figure 1A:
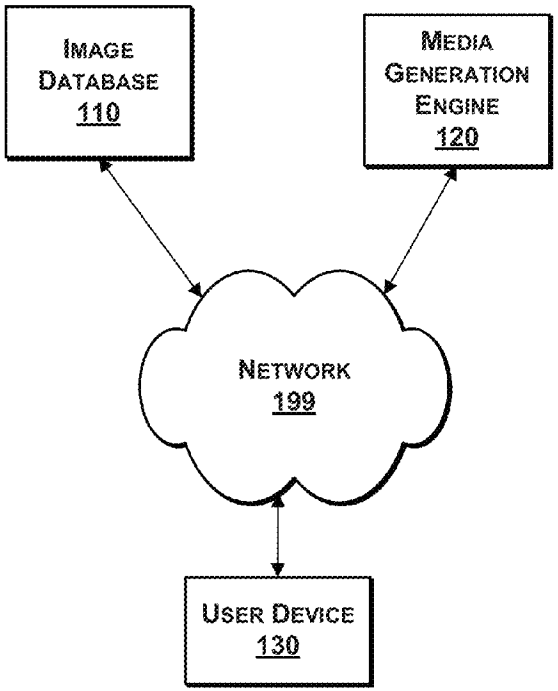
FIG. 1A is a block diagram illustrating a system to generate music from an image or collage of images, according to one embodiment.

FIG. 1A is a block diagram illustrating a system 100 to generate music from an image or collage of images, according to one embodiment. The system 100 comprises an image database 110, a media generation engine 120, and a user device 130. Many other components can be present in other embodiments, for example, firewalls, access points, controllers, routers, gateways, switches, SDN (software defined networking) controllers, and intrusion detectors, without limitation.

The image database 110 can be any resource for images used to generate music. For example, and without limitation, the image database 110 can comprise an online Picasa account, or search results from Google Images. In some implementations, the image database 110 stores musical compositions associated with stored images.

The images can be photographs, online pictures, or animations, for example. The images can be independent, or a portion of a collage or video stream. Examples of media file formats include MP3, JPG, GIF, PDF and custom camera formats. In one case, the image is scanned into a digital format with a larger file having more pixilation than a smaller file.

The media generation engine 120 generates musical compositions for images. In one embodiment, the media generation engine 120 provides a user interface for users to configure musical elements and how they relate to image pixels. Instruments or groups of instruments can be selected (e.g., string quartet, symphony, jazz band, etc.). An instrument can be mapped to a group of pixel values such as mapping a piano to blue colors, and piano chords to different shades of blue. Likewise, a chord can be mapped to a color, and instruments to play the chord to different shades of the color. In another embodiment, music elements can have a default or random assignment. Example of pixel values for color are hex codes (e.g., #33CC33) and RGB vector values (e.g., 51, 104, 51 corresponds to hex code #33CC33). Instrument sounds can be pre-recorded snippets, or computer generated.

A play speed, play direction and type of instruments are also adjustable by a content creator through one embodiment of the media generation engine 120. These are merely examples of many design specific settings that are available. The play speed allows a tempo to be sped up or slowed down, affecting a mood of the playback. The play direction dictates how pixels are read from the subject image source.

The media generation engine 120 generates a musical composition corresponding to the image. To do so, in one touch embodiment, a template is associated with the image to set music element mappings, genre, instrument types, mood, and the like. In a customized embodiment, a sequential order for reading individual pixel values from the source image is determined. The order can be default or selected by the user. Many variations are possible, such as row by row, column by column, every other pixel, spiral from middle to outside perimeter, or any appropriate pattern.

The media generation engine 120 receives individual pixels in the sequential order. Each pixel is formed from digital information about color, brightness, intensity, and other characteristics. Therefore, pixel values can be extracted from an image file. Alternatively, pixel values can be estimated from a display of the image on a screen, without the actual image file.

Next, the media generation engine 120 can match musical elements to individual pixel values based on assignments. In one embodiment, a histogram of a source image is mapped to musical elements wherein frequency of a certain pixel can indicate volume for instruments played for that color. Also, a musical composition can be garneted from the histogram by mapping the aggregate number of a certain pixel colors to musical elements. A resulting musical composition can be stored for real-time playback, for sharing, or for playback at a later time. Certain global characteristics can be set by user or by default, such a volume and playback speed.

In a different embodiment, the media generation engine 120 analyses pixels of a source image and selects an existing musical composition from an audio collection that most closely matches the analysis results. For example, a histogram of pixels can indicate a calm mood with lots of mid-range instruments, so a jazz song with an emphasis on piano tones is selected.

The media generation engine 120 can be implemented in a single server, across many servers, as a software as a service, hardware, software, or a combination of hardware and software. Example components of the media generation engine 120 are set forth in more detail below with respect to FIG. 1B.

The user device 130 can provide a user interface for the music generation architecture. In one case, an app is downloaded an installed. The app connects with backend resource on the Internet (e.g., the image database 110 and the media generation engine 120). In one case, the entire system 100 to generate music is operated locally from the user device 130. In another case, a network browser interfaces with the image database 110 and/or the media generation engine 120. In an embodiment, the user device 130 includes audio speakers and a display for audio and optionally video playback. Further, a local media application plays back digital media files.

The user device 130 can comprise a smart phone, a tablet, a phablet, a PC, a touch screen device, or any appropriate computing device, such as the generic computing device discussed below in association with FIG. 2C Network 130 can be one or more of: the Internet, a wide area network, a local area network, any data network, an IEEE 802.11 protocol Wi-Fi network, a 3G or 4G cellular network, a Bluetooth network, or any other appropriate communication network. Each of the Image database 110, the media generation engine 120, and the user device 130 is connected to the network 199 for communications. In some embodiments of the system 100A, the image database 110 and the media generation engine 120 execute in the same physical device. The components can be located on a common LAN, or spread across a WAN in a cloud-computing configuration.

In one embodiment, users create a gallery with multiple canvases of generated music compositions or generated images, videos or collages, along with source media. The gallery can store individual canvases can be marked for public viewing or private viewing. Images can be uploaded to a gallery, and a template for musical generation associated with the image. The template can be from another canvas, or from a library of themed templates (e.g., rock, symphony, or electronic dance music).

In one case, the gallery is part of a larger online community or social networking service that shares canvases for browsing by members or friends (e.g., Pinterest or Facebook). Viewers may be allowed to edit or contribute to generated media, and add a lyrics overlay to musical compositions. Canvases can also be sold or offered for download from galleries.

Figure 1B:
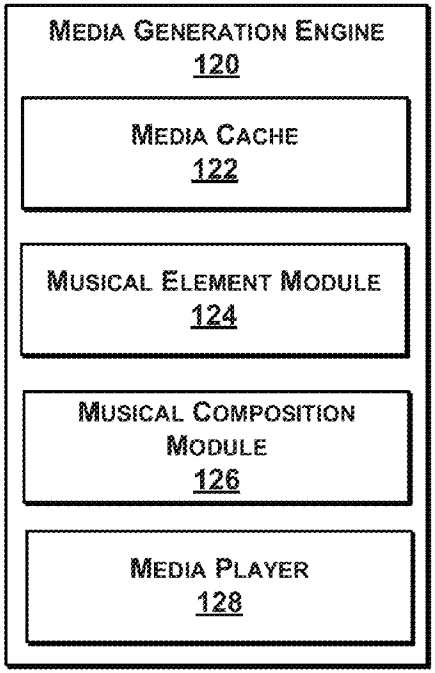
FIG. 1B is a more detailed block diagram of the media generation engine, according to an embodiment.

FIG. 1B is a more detailed block diagram of the media generation engine 120, according to an embodiment. The media generation engine 120 includes a media cache 122, a musical element module 134, a musical composition module 136 and a media player 138.

The media cache 122 stores source images used for musical compositions. The musical element module 134 defines assignments between pixels and musical elements used as a base for musical compositions. The musical composition module 136 analyzes an image to determine pixel values for matching to musical elements as assigned. The media player 138 reads the musical composition to produce audio and optionally video for playback. Audio playback can be concurrent with display of a source image. Also, audio generated from a slide show as a whole can be played back with individual images from the slide show. A template associated with an image or musical composition can be changed during playback to modify the generated media.

Figure 1C:
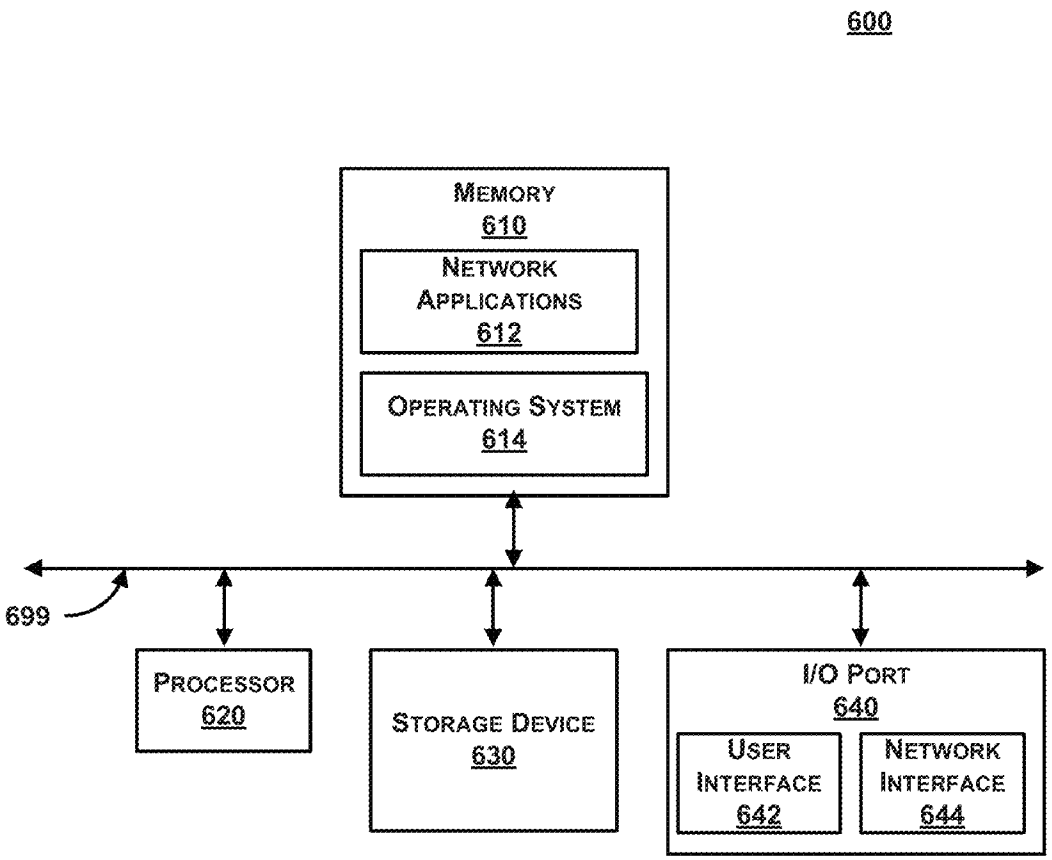
FIG. 1C is a block diagram illustrating an exemplary computing device for various components described herein, according to one embodiment.

FIG. 1C is a block diagram illustrating an exemplary computing device 900 for use in the system 100 of FIG. 1, according to one embodiment. The computing device 900 is an exemplary device that is implementable for each of the components of the system 100, including the image database 110, the media generation engine 120, and user device 130. The computing device 900 can be a mobile computing device, a laptop device, a smartphone, a tablet device, a phablet device, a video game console, a personal computing device, a stationary computing device, a server blade, an Internet appliance, a virtual computing device, a distributed computing device, a cloud-based computing device, or any appropriate processor-driven device.

The computing device 900, of the present embodiment, includes a memory 910, a processor 920, a storage drive 930, and an I/O port 940. Each of the components is coupled for electronic communication via a bus 999. Communication can be digital and/or analog, and use any suitable protocol.

The memory 910 further comprises network applications 912 and an operating system 914. The network applications 912 can include components of the media generation engine 120 or an app on the user device 130. Other network applications 912 can include a web browser, a mobile application, an application that uses networking, a remote application executing locally, a network protocol application, a network management application, a network routing application, or the like.

The operating system 914 can be one of the Microsoft Windows® family of operating systems (e.g., Windows 95, 98, Me, Windows NT, Windows 2000, Windows XP, Windows XP x64 Edition, Windows Vista, Windows CE, Windows Mobile, Windows 7 or Windows 8), Linux, HP-UX, UNIX, Sun OS, Solaris, Mac OS X, Alpha OS, AIX, IRIX32, or IRIX64. Other operating systems may be used. Microsoft Windows is a trademark of Microsoft Corporation.

The processor 920 can be a network processor (e.g., optimized for IEEE 802.11), a general purpose processor, an application-specific integrated circuit (ASIC), a field programmable gate array (FPGA), a reduced instruction set controller (RISC) processor, an integrated circuit, or the like. Qualcomm Atheros, Broadcom Corporation, and Marvell Semiconductors manufacture processors that are optimized for IEEE 802.11 devices. The processor 920 can be single core, multiple core, or include more than one processing elements. The processor 920 can be disposed on silicon or any other suitable material. The processor 920 can receive and execute instructions and data stored in the memory 910 or the storage drive 930.

The storage drive 930 can be any non-volatile type of storage such as a magnetic disc, EEPROM (electronically erasable programmable read-only memory), Flash, or the like. The storage drive 930 stores code and data for applications.

The I/O port 940 further comprises a user interface 942 and a network interface 944. The user interface 942 can output to a display device and receive input from, for example, a keyboard. The network interface 944 (e.g. RF antennae) connects to a medium such as Ethernet or Wi-Fi for data input and output.

Many of the functionalities described herein can be implemented with computer software, computer hardware, or a combination.

Computer software products (e.g., non-transitory computer products storing source code) may be written in any of various suitable programming languages, such as C, C++, C#, Oracle® Java, JavaScript, PHP, Python, Perl, Ruby, AJAX, and Adobe® Flash®. The computer software product may be an independent application with data input and data display modules. Alternatively, the computer software products may be classes that are instantiated as distributed objects. The computer software products may also be component software such as Java Beans (from Sun Microsystems) or Enterprise Java Beans (EJB from Sun Microsystems).

Furthermore, the computer that is running the previously mentioned computer software may be connected to a network and may interface with other computers using this network. The network may be on an intranet or the Internet, among others. The network may be a wired network (e.g., using copper), telephone network, packet network, an optical network (e.g., using optical fiber), or a wireless network, or any combination of these. For example, data and other information may be passed between the computer and components (or steps) of a system of the invention using a wireless network using a protocol such as Wi-Fi (IEEE standards 802.11, 802.11a, 802.11b, 802.11e, 802.11g, 802.11i, 802.11n, and 802.11ac, just to name a few examples). For example, signals from a computer may be transferred, at least in part, wirelessly to components or other computers.

In an embodiment, with a Web browser executing on a computer workstation system, a user accesses a system on the World Wide Web (WWW) through a network such as the Internet. The Web browser is used to download web pages or other content in various formats including HTML, XML, text, PDF, and postscript, and may be used to upload information to other parts of the system. The Web browser may use uniform resource identifiers (URLs) to identify resources on the Web and hypertext transfer protocol (HTTP) in transferring files on the Web.

II. Method for Generating Music from an Image or Collage

Figure 2A:
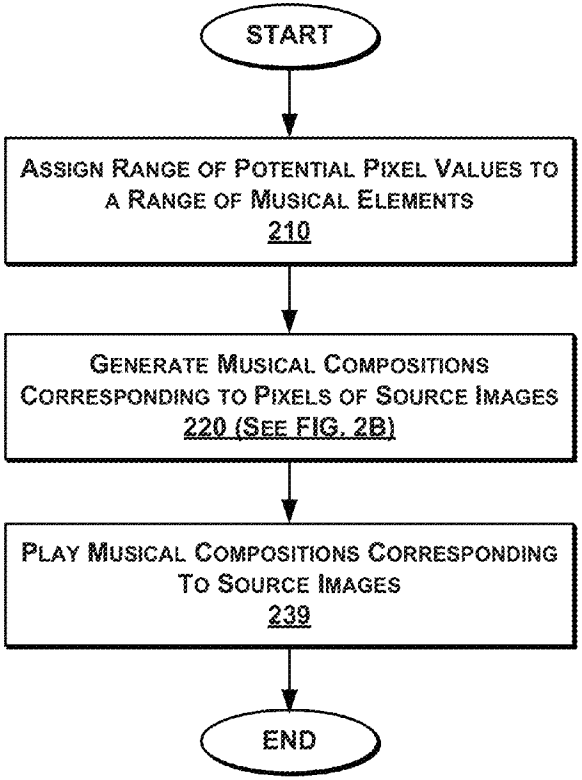
FIG. 2A is a flow diagram illustrating a method for generating music from an image or collage, according to an embodiment.

FIG. 2A is a flow diagram illustrating a method 200A for generating music from an image or collage, according to an embodiment. A range of potential pixel values is assigned to a range of musical elements (step 210). Musical compositions are generated corresponding to pixels of source images (step 220), as described in more detail below in association with FIG. 2B. Musical compositions corresponding to source images are played (step 230).

Figure 2B:
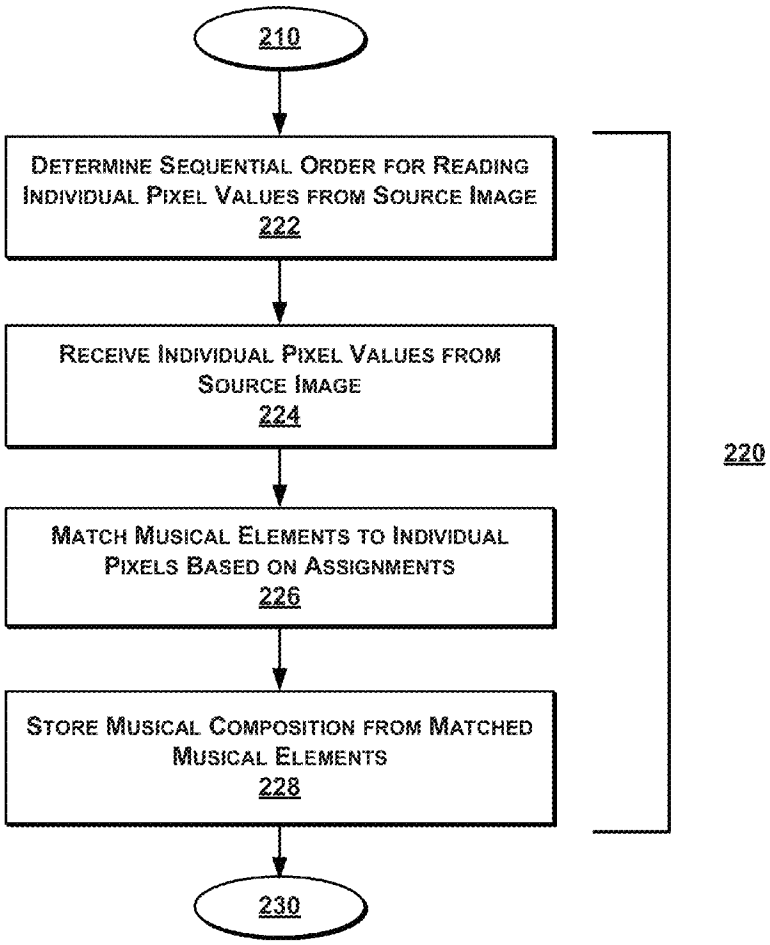
FIG. 2B is a more detailed flow diagram illustrating the step of generating musical compositions corresponding to pixels of source images, according to an embodiment.

FIG. 2B is a more detailed flow diagram illustrating the step 220 of generating musical compositions corresponding to pixels of source images, according to an embodiment. A sequential order for reading individual pixel values from a source image is determined (step 222). Individual pixel values are received from a source image (step 224). Musical elements are matched to individual pixels based on assignments (step 226). Musical compositions are stored from matched musical elements (step 228).

Figure 2C:
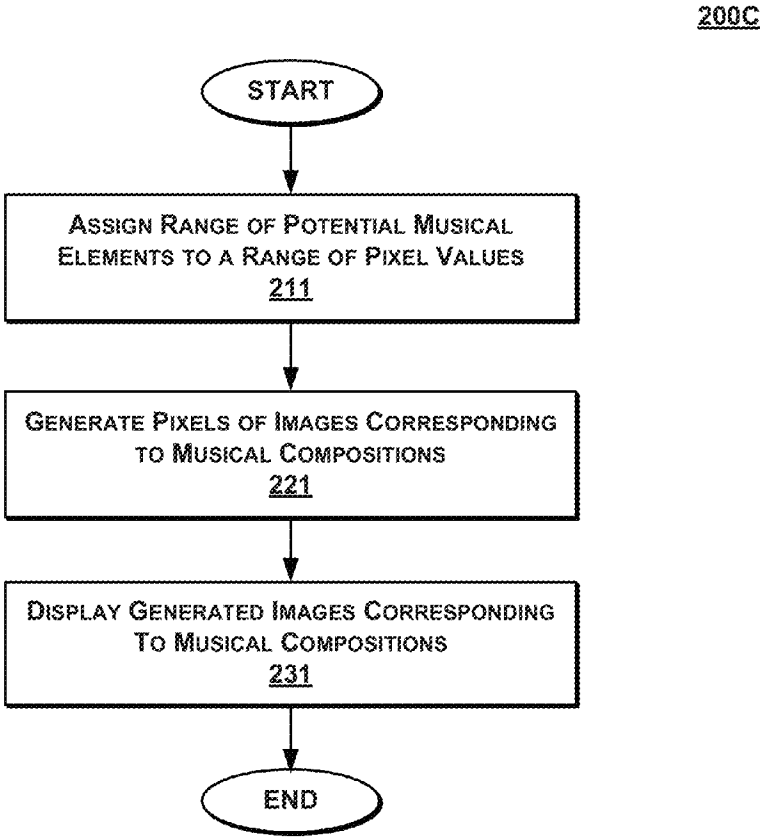
FIG. 2C is a flow diagram showing the analog process to FIG. 2B, in that a method generates images from music compositions.

FIG. 2C is a flow diagram showing the analog process to FIG. 2B, in that a method 200C generates images from music compositions. A range of potential musical elements are assigned to a range of pixel values (step 211). Pixels are generated for images corresponding to musical compositions (step 221). Generated images corresponding to musical compositions are displayed (step 231).

When performing the reverse method 200C, one difference is that musical instruments and chords are layered (i.e., played in combination at the same time). In one embodiment, musical compositions are pixelated by taking samples at a certain frequency. An individual sample can then be converted to an image pixel including all instruments and chords playing at that snapshot moment. In another embodiment, individual instruments are observed over time and pixelated for conversion to pixels. Many other embodiments are possible. In other instances, other musical characteristics such a tempo and volume can be converted to other pixel or image characteristics such as brightness.

Figure 3A:
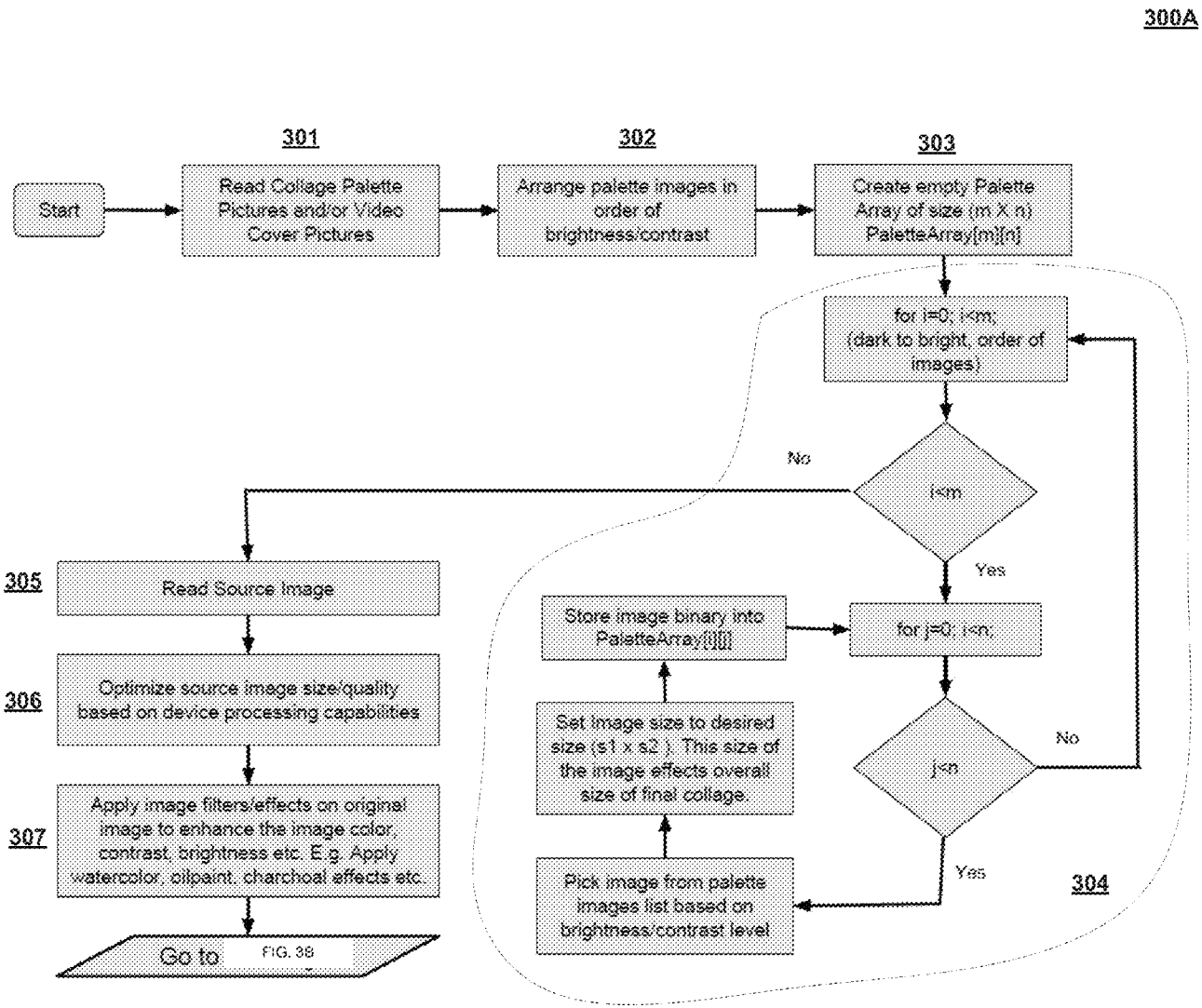
FIGS. 3A-3B form a flow diagram illustrating a method for generating collages from images or videos, according to one embodiment.
Figure 3B:
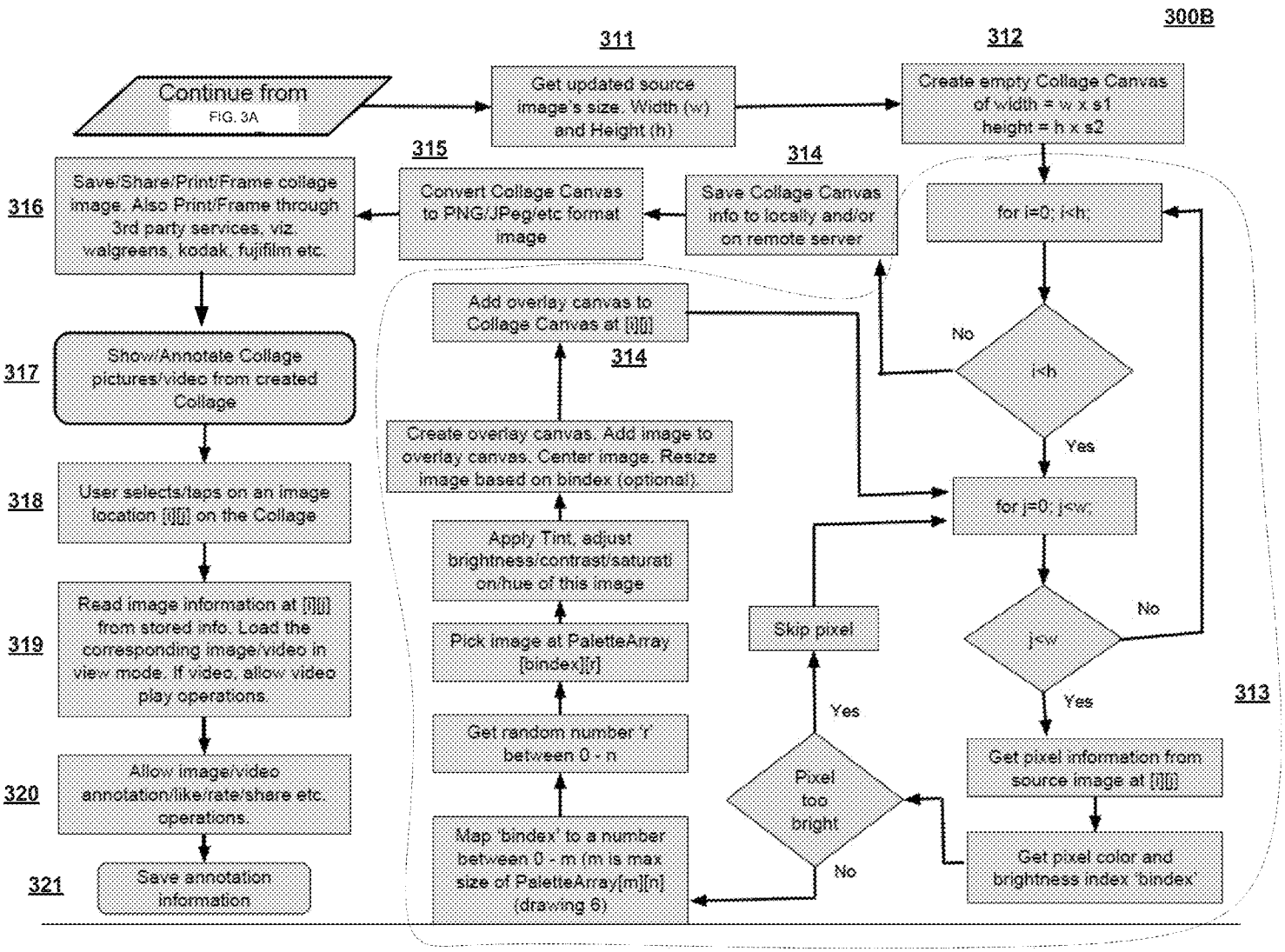

FIGS. 3A-3B show an alternative embodiment for generating music from a source image. FIG. 3A is a flow diagram illustrating a method 300A for generating collages from images or videos, according to one embodiment. A collage palette picture and/or video cover pictures are read (step 301). A palette of images is arranged in order of, for example, brightness/contrast (step 302). An empty palette is then created (step 303). Each of the images, in order, is stored in a palette array after being set to a desired size (loop 304). A master image is accessed (step 305) for optimizing and processing (step 306). The master image can be down sampled in size and quality for smart phones or up sampled in size and quality of a PC device, for instance. Also, image filters and effects can be applied (step 307).

With respect to the loop 304 of FIG. 3A, the loop is dependent upon a size of palette from dark to bright, for example, for palette size of 15. Variable n represents number of different images for each palette (minimum n=1, maximum n=any number greater than 1). If n=2, then the example palette will be an array [15][2] that will have 2 different images for each brightness/contrast level. In the loop, first an empty palette array [m][n] is created. Then all of the images are traversed in order of brightness/contrast and add them to the palette array:

```
for (i=0; i<m; ++i) {
    for (j=0; j<n; ++j) {
        paletteArray[i][j] = <selected image>
    }
}
```

The method 300A continued in FIG. 3B, parameters such as width and height for the master image are retrieved as updated (step 311) used to create an empty collage canvas (step 312). Various techniques can be used to fill the empty collage canvas with particular images or videos from the image palette (loop 313). The collage is saved (step 314) and can be converted to a preferred file format (step 315). The collage can then be shared or printed (step 316) and shown or annotated (step 317). To do so, a user selects a particular image in the collage (step 318) to load (step 319). After annotations and other optional operations for customizing are performed (step 320), the annotation information is saved (step 321).

In the loop 313 of FIG. 3B, assume the size of original image is w×h, and the size of each palette image is s1×s2. An empty Canvas 'C' is created of size (w×s1)×(h×s2). For the original picture (w×h), each pixel is traversed (in rows and columns) to get brightness and color information:

```
    for (i=0; i<h; ++i ) { // for each row in the original
image
        for (j=0; j<w; ++j) { // for each col in the current
row
            pixelInformation = for pixel[i][j]
            // based on pixel brightness/color information,
pick the image from palletArray and place it on the canvas 'C'
at location [i x s1, j x s2]
        }
    }
```

The collage canvas can be saved locally or on a server in any appropriate format (e.g., PNG, JPG, PDF or GIF). Next, the collage canvas can be shared, printed, or otherwise distributed. Individual images can be annotated, including separate instances of the same image.

Figure 3C:
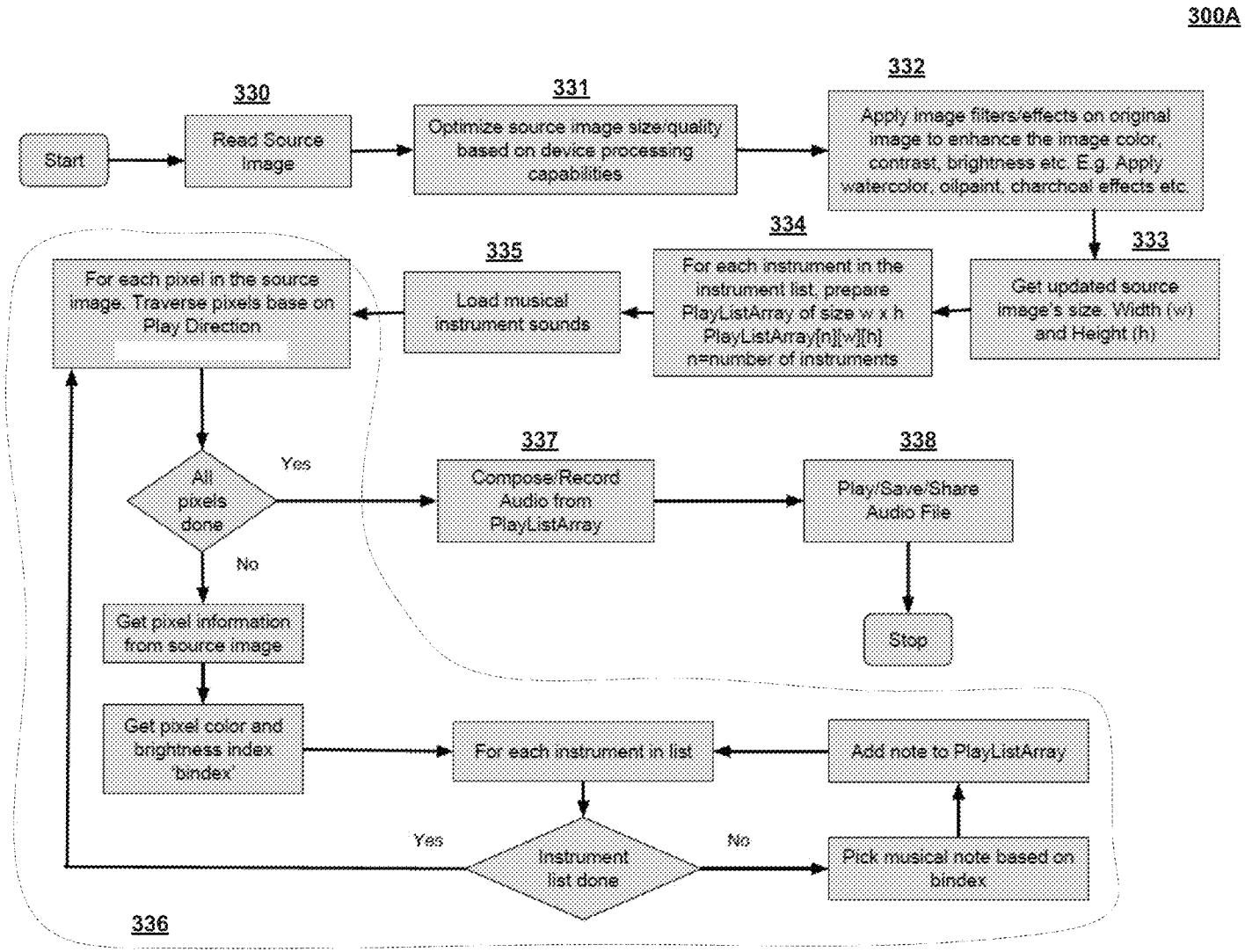
FIG. 3C is a flow diagram illustrating a method for generating music from an image or collage, according to one embodiment.

FIG. 3C is a flow diagram illustrating a method 300C for generating music from an image or collage, according to one embodiment. The method 300C can be implemented by a smart phone, a tablet, a phablet, a PC, or any appropriate computing device, such as the generic computing device discussed below in association with FIG. 2C.

As discussed above, a master image is loaded (step 330) for optimizing and processing (step 331). The musical settings are retrieved (step 335). A play list array is generated and traversed until all pixels are read (loop 336). Each pixel can represent, for example, a chord or set of chords, one or more instrument, a song, or the like. Pixels can also represent speed, volume, and other characteristics of music. Palette images of a collage can also be used in the same described manner as pixels to generate music. In one embodiment, a database maps pixel characteristics to music characteristics. Finally, audio is composed or recorded (step 337) for playback, storing or sharing (step 338).

III. Methods for Generating Collages

Figure 4A:
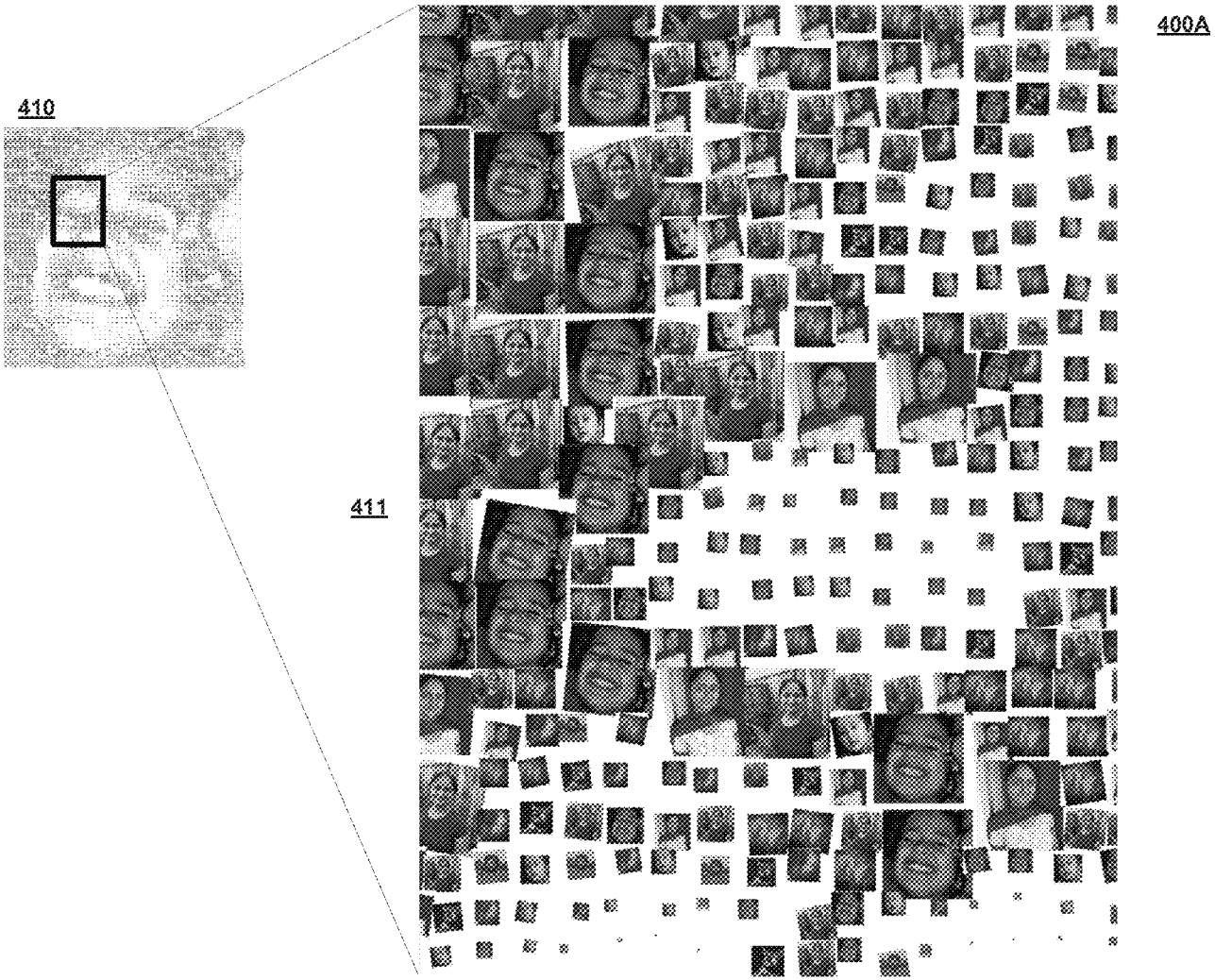
FIGS. 4A and 4B illustrate exemplary collages and generated from palette images, according to one embodiment.
Figure 4B:
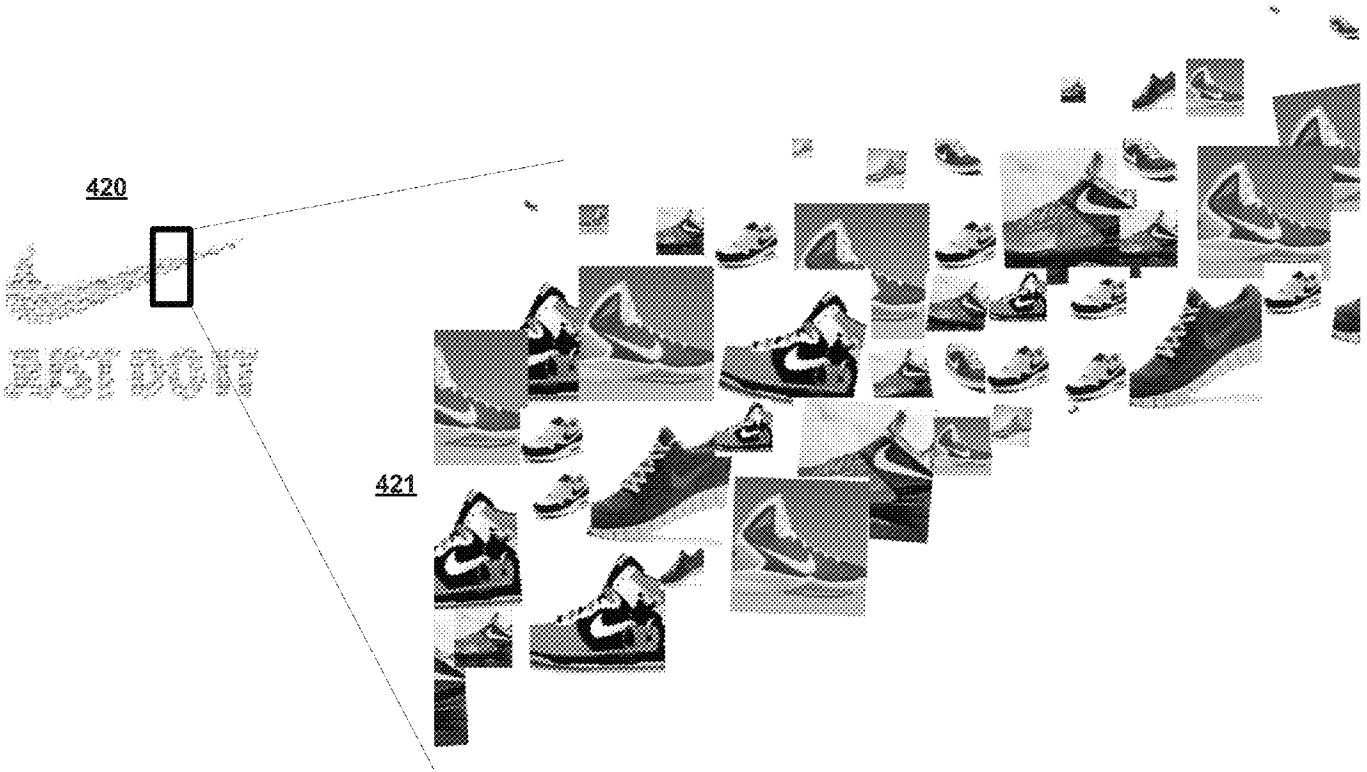

FIGS. 4A and 4B illustrate exemplary collages 400A and 400B generated from palette images, according to one embodiment. A master image 410 is composed of multiple palette images, a section of which is shown in detail 411. The master image 410, as referred to herein, can be selected by a user to be utilized as a template for applying palette images. The palette images, as referred to herein, are one or more captured images utilized as individual pixels for generating the master image. In one embodiment, the master image 410 and one of the palette images can be the same captured image. FIG. 4A shows a happy child face as a master image 410 and the same happy child face, along with a mother, father and aunt as palette images. FIG. 4B shows a Nike swoosh and the text Just Do It as a master image 420 and various pictures of Nike shoes as palette images, a section of which is shown in detail 421.

A master image can be printed as a poster or other analog image, or be shared digitally. In one embodiment, a digital master image has controls such as zoom, pan and rotate. For example, the master image can be shared on Facebook as a single image. The master image and palette images can be selected from an online Facebook gallery or locally from a smart phone physical memory.

Figure 5A:
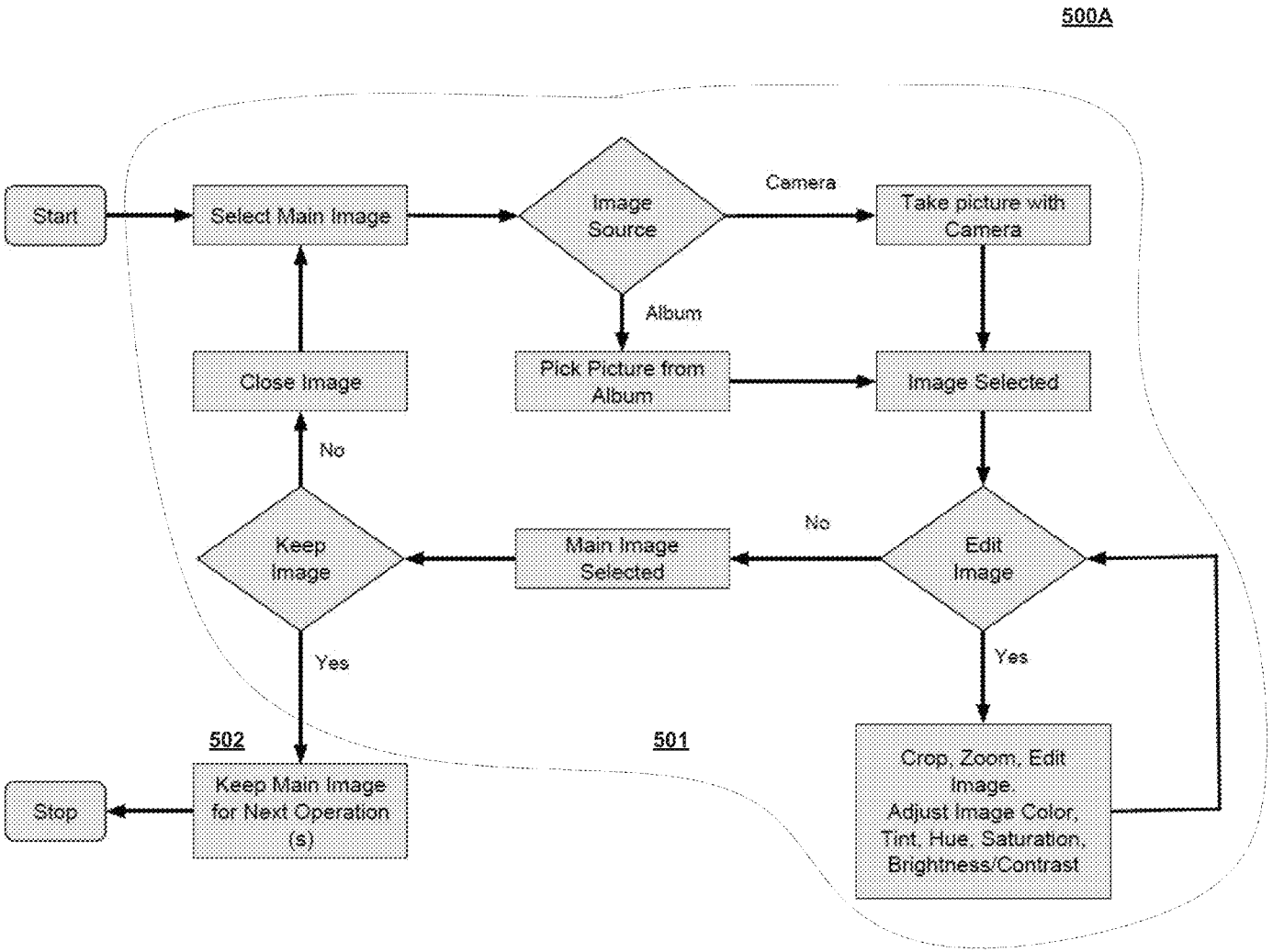
FIG. 5A is a flow diagram illustrating a method for selecting a main image for a collage, according to one embodiment.

FIG. 5A is a flow diagram illustrating a method 500A for selecting a main image for a collage, according to one embodiment. An image can be sourced from an existing database or captured in real-time for selection. In some embodiments, a picture album or other interface to a collection of pictures is accessed. A user scrolls through to find a desired image for use. In some embodiments, an image is captured from a camera device on a cell phone or other device in real-time and imported into the application.

A selected image can be edited to optimize for its intended use. An internal or external application applies various types of processing to the image. For example, the image can be cropped, zoomed in or out, adjusted for color, tint, hue, saturation, brightness/contrast, and the like.

If the user is satisfied with the image, the main image is committed for the collage (step 502). Otherwise, the image is closed and the process repeats until a satisfactory image is selected (loop 501).

Figure 5B:
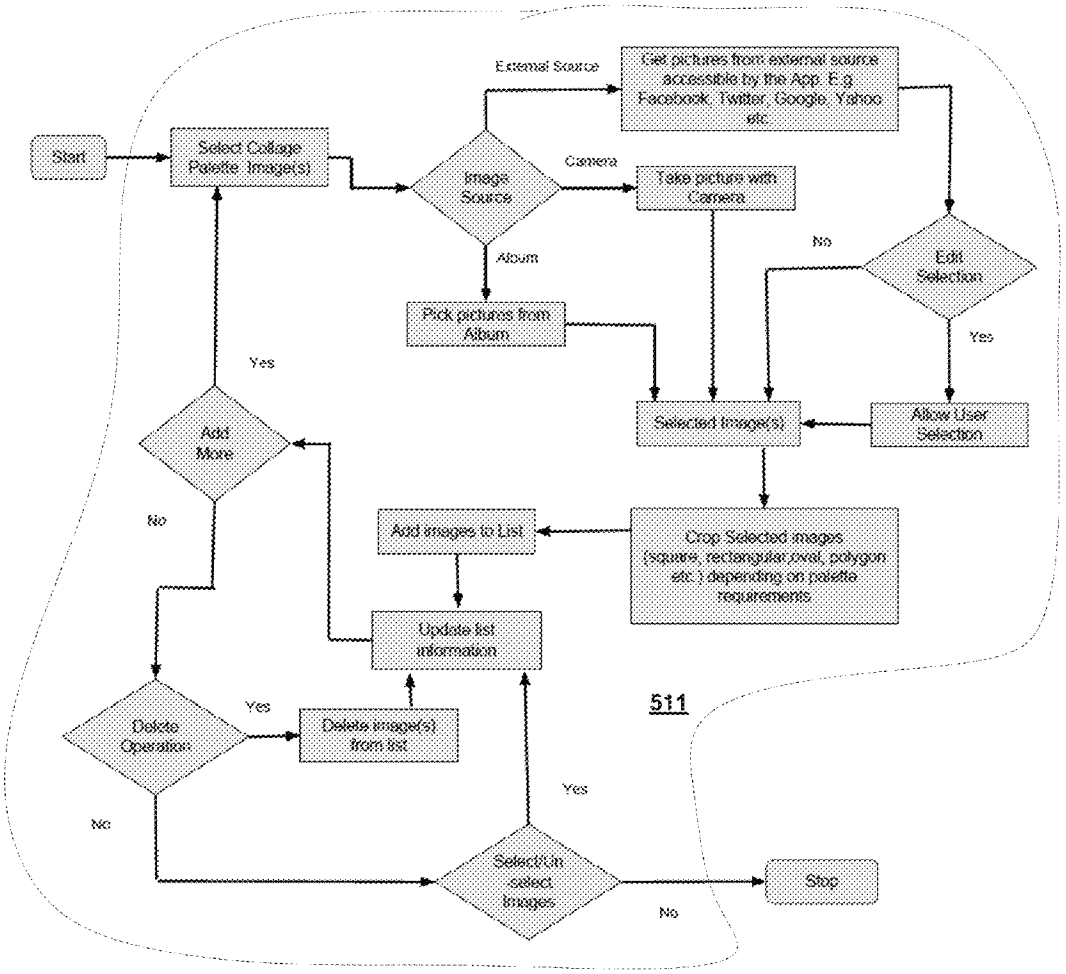
FIG. 5B is a flow diagram illustrating a method for selecting collage palette images for a collage, according to one embodiment.

FIG. 5B is a flow diagram illustrating a method 500B for selecting collage palette images for a collage, according to one embodiment. Images can be sourced from, for example, an album, captured in real-time from a camera device or downloaded from an online source. Various palette images can be pulled from different sources.

Selected images may be required to meet certain uniform constraints with respect to size, shape, color, or other characteristics. Edits can be applied automatically or manually to meet the constraints. At any point, additional images can be added or deleted from the palette (altogether loop 511).

Figure 5C:
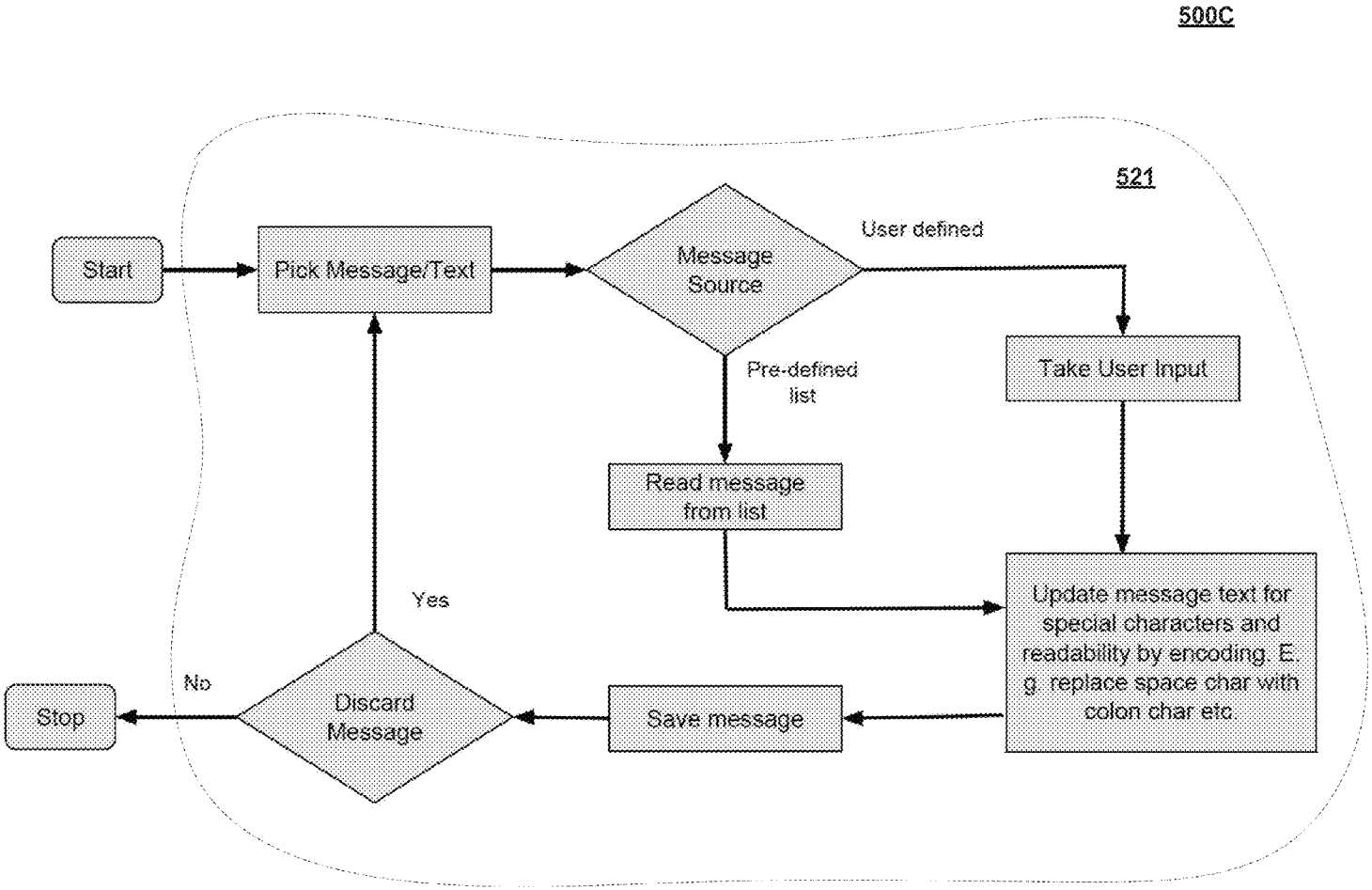
FIG. 5C is a flow diagram illustrating a method for selecting an iPiXiFi message, according to one embodiment.

FIG. 5C is a flow diagram illustrating a method 500C for selecting an iPiXiFi message, according to one embodiment. The message can be predefined online or from a local database. Alternatively, the message can be user defined as entered by a keyboard, voice recognition, or the like. Preformatting may be necessary for special characters, such as filling in a space with a colon. The message is saved and can be modified, deleted or replaced at any point. More specifically, user picks an image to be pixified. User picks (or create custom) message (e.g., Happy Birthday Joe). The pixified image is created using message text by changing character font color, size, font-face/type (altogether loop 521).

Figure 5D:
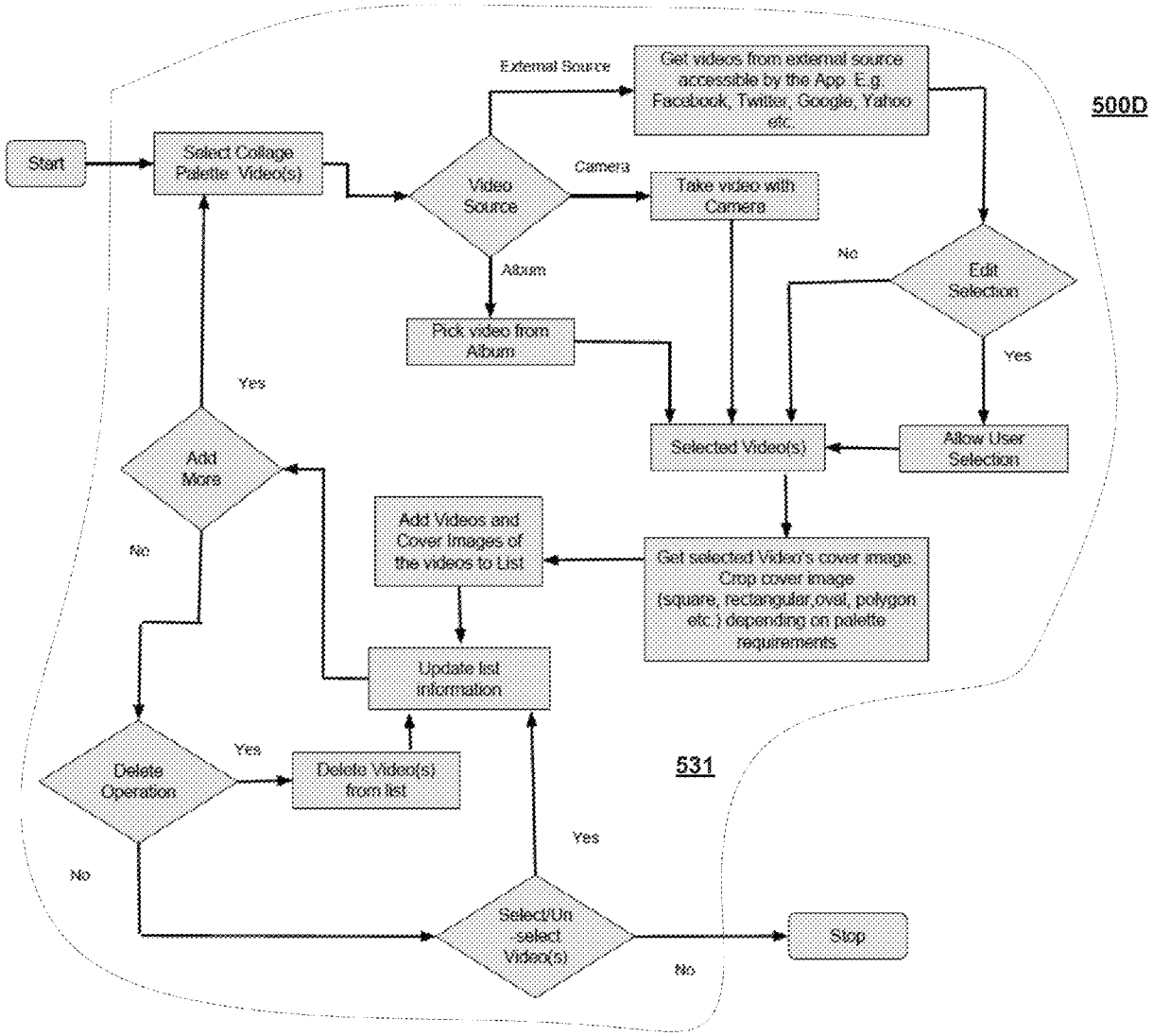
FIG. 5D is a flow diagram illustrating a method for selecting collage palette videos, according to one embodiment.

FIG. 5D is a flow diagram illustrating a method 500D for selecting collage palette videos, according to one embodiment. Video clips are sourced from an album, recorded in real-time from a camera device, or downloaded form an online resource. A master image, or cover image, is selected from a single frame or still, or as otherwise selected by a user from a separate source. Video clips and cover images can be edited automatically or manually before the collage is generated. Video clips can be added, deleted or modified at any time (altogether loop 531).

Figure 5E:
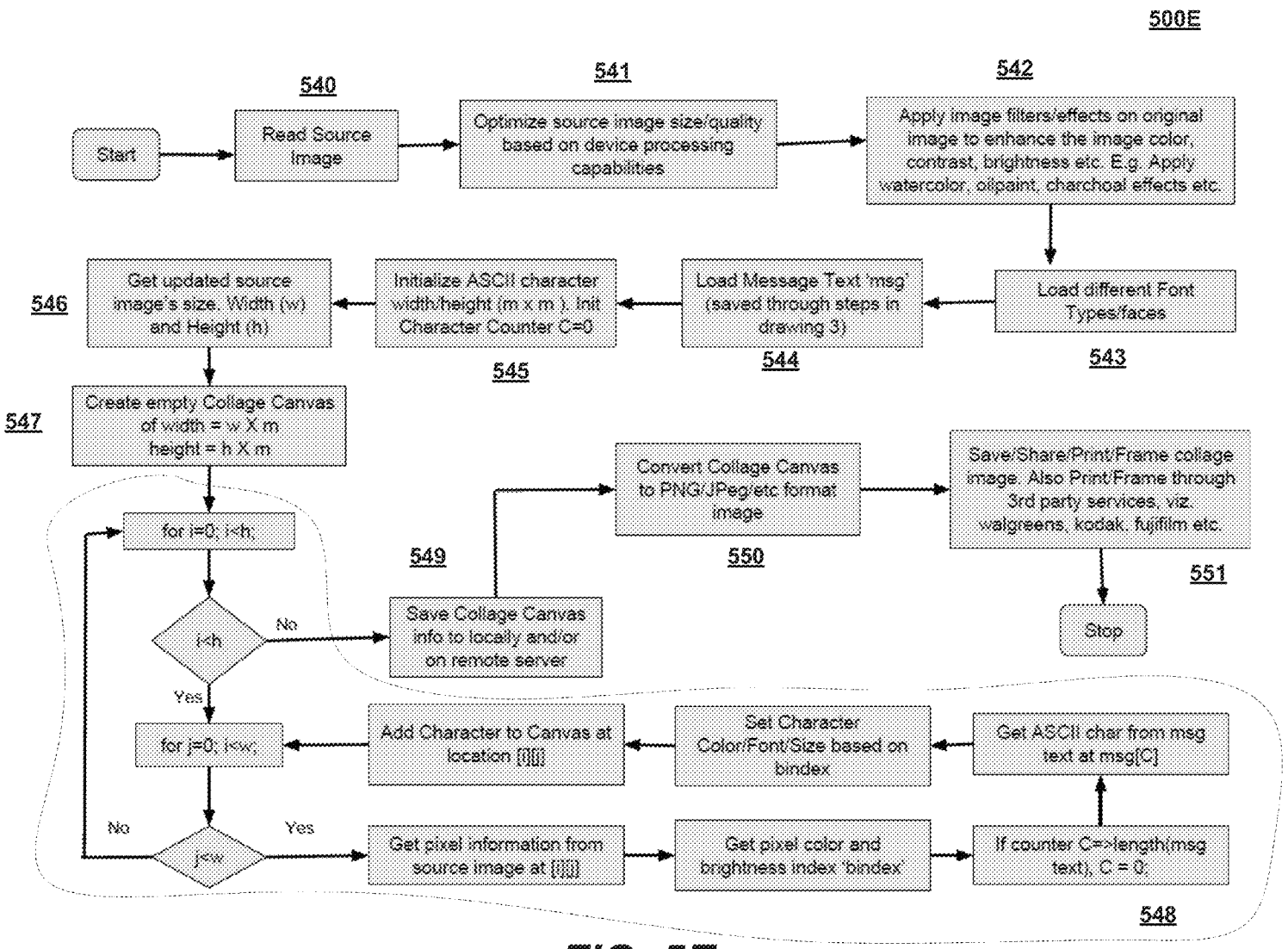
FIG. 5E is a flow diagram illustrating a method for generating collages from text, according to one embodiment.

FIG. 5E is a flow diagram illustrating a method 500E for generating collages from text, according to one embodiment.

A master image (text image or non-text image) is read (step 540), optimized (step 541), processed (step 542) and sized as discussed above. Font type faces are loaded using the preconfigured message (step 543). A message text is loaded (step 544) and characters initialized (step 545). The source image size is updated (step 546) and then an empty collage canvas is generated (step 547) and filled with, for example, ASCII characters (loop 548). The collage is stored (step 549) and converted to an appropriate format (step 550) for sharing (step 551).

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

We claim:

1. A computer-implemented method for generating music from image pixels, the method comprising the steps of:

assigning a range of potential pixel values to a range of musical elements, wherein each musical element comprises at least one chord from at least one musical instrument;

generating a musical composition corresponding to a source image, comprising:

determining a sequential order for reading individual pixel values from the source image comprising a plurality of pixels;

receiving individual pixel values from the source image in the sequential order;

matching a musical element to each of the individual pixel values based on assignments; and storing a musical composition including an indication of each musical element of the source image according to the sequential order; and playing the musical composition corresponding to the source image.

2. The method of claim 1, further comprising optimizing the source image.

3. The method of claim 1, further comprising:

generating visual feedback for the individual pixel concurrent with playing a portion of the musical composition generated from the individual pixel value of the individual pixel in the source image.

4. The method of claim 1, wherein the sequential order comprises at least one of: row by row, and column by column.

5. The method of claim 1, wherein the sequential order is derived from user interaction with the source image, from a touchscreen displaying the source image.

6. The method of claim 1, wherein more than one musical element is played at the same time for combining musical instrument sounds.

7. The method of claim 1, further comprising:

publishing the musical composition from an online server.

8. The method of claim 1, further comprising:

receiving user input used to for assigning the range of potential pixel values to the range of musical elements.

9. The method of claim 1, wherein the image source is part of a collage of images, and wherein the musical composition is generated from multiple images of the collage of images.

10. The method of claim 1, wherein the source image comprises a digital photograph.

11. The method of claim 1, wherein the source image is part of a video comprised of a stream of images, and wherein the musical composition is generated from multiple images of the video.

12. The method of claim 1, wherein the pixel values correspond to a quantitative expression of at least one of:

color, brightness, contrast, luminance, and a custom characteristic.

13. The method of claim 1, wherein at least one of the pixel values determines a volume of audio, or of a particular musical instrument.

14. A non-transitory computer readable media, storing instructions, that when executed, perform a computer-implemented method for generating music from image pixels, the method comprising the steps of:

assigning a range of potential pixel values to a range of musical elements, wherein each musical element comprises at least one chord from at least one musical instrument;

generating a musical composition corresponding to a source image, comprising:

determining a sequential order for reading individual pixel values from the source image comprising a plurality of pixels;

receiving individual pixel values from the source image in the sequential order;

matching a musical element to each of the individual pixel values based on assignments; and storing a musical composition including an indication of each musical element of the source image according to the sequential order; and playing the musical composition corresponding to the source image.

15. A device to generate music from image pixels, the device comprising:

processor; and memory, storing:

a first module to assign a range of potential pixel values to a range of musical elements, wherein each musical element comprises at least one chord from at least one musical instrument;

a second module to generate a musical composition corresponding to a source image, by:

determining a sequential order for reading individual pixel values from the source image comprising a plurality of pixels;

receiving individual pixel values from the source image in the sequential order;

matching a musical element to each of the individual pixel values based on assignments; and storing a musical composition including an indication of each musical element of the source image according to the sequential order; and a third module to play the musical composition corresponding to the source image.

* * * * *